United States Patent [19]

Schulz, Jr.

[11] Patent Number: 4,903,949

[45] Date of Patent: Feb. 27, 1990

[54] FOUNDATION UNIT HAVING COLLAPSIBLE SUPPORT MEMBERS

[75] Inventor: Martin Schulz, Jr., Brenham, Tex.

[73] Assignee: Steadley Company, Carthage, Mo.

[21] Appl. No.: 348,406

[22] Filed: May 8, 1989

[51] Int. Cl.[4] ..... F16F 3/02

[52] U.S. Cl. ..... 267/103; 5/240

[58] Field of Search ..... 5/240, 247; 267/103, 267/108, 110, 144

[56] References Cited

U.S. PATENT DOCUMENTS

| | | | |
|---|---|---|---|
| 158,413 | 1/1875 | Hatch | 5/247 |
| 1,040,693 | 10/1912 | Kohler | 5/240 X |
| 4,377,279 | 3/1983 | Schulz, Jr. et al. | 267/103 |
| 4,770,397 | 9/1988 | Schulz, Jr. | 267/144 |
| 4,771,995 | 9/1988 | Wells et al. | 267/103 |

*Primary Examiner*—Duane A. Reger

*Attorney, Agent, or Firm*—Lee, Mann, Smith, McWilliams & Sweeney

[57] ABSTRACT

A foundation unit which can be collapsed for compact shipping and which later can be elevated to a fully expanded state. The foundation unit includes a rectangular, grid wire top bearing structure, a rigid bottom substructure, and a series of spaced, parallel rows of support members extending between the top bearing structure and the bottom substructure. The support members are hingedly secured to the top bearing structure and the bottom substructure to permit reduction of the foundation unit to the collapsed state with the elements of the rows of support members lying essential prone. In the elevated state, each of the rows of support members is composed at least in part of a plurality of spring wire segments comprising a pair of generally flat support elements forming a generally V-shaped configuration.

10 Claims, 2 Drawing Sheets

FOUNDATION UNIT HAVING COLLAPSIBLE SUPPORT MEMBERS

BACKGROUND OF THE INVENTION

This invention relates to foundation units, and more particularly to a foundation unit which may be shipped in a collapsed state and later elevated to a fully expanded state using attached components of the foundation unit alone, or such components plus additionally added elements.

U.S. Pat. No. 4,377,279, assigned to the assignee of this application, pertains to a foldable steel wire foundation unit such as a box spring for bedding purposes. The foundation unit is composed of a rigid bottom substructure, a flat top wire grid structure, and a plurality of spaced, parallel rows of substantially flat support members extending between the grid structure and the bottom substructure. Because the support members are substantially flat and are hingedly secured to the grid structure and the bottom substructure, the foundation unit can be fully assembled at a factory and then shipped to the customer in a collapsed orientation, with the customer ultimately raising the unit to a fully expanded orientation and locking the structure in place by means of a plurality of oppositely directed struts.

U.S. Pat. No. 4,770,397 is an improvement over the structure of U.S. Pat. No. 4,377,279, and is also assigned to the assignee of the present application. The '397 patent is directed to a different type of wire support member for a foundation unit, in the form of planer wire elements comprising a pair of oppositely oriented sinuous wire segments. The wire elements provide some resiliency, and a foundation unit employing the wire elements is capable of being collapsed for shipping and expanding for ultimate use.

The present invention is intended to be an improvement over those disclosed in U.S. Pat. Nos. 4,377,279 and 4,770,397, the disclosures of which are incorporated herein by reference. Due to the nature of the present invention, which will become more apparent from the description below, auxiliary stabilizers such as struts are unnecessary.

SUMMARY OF THE INVENTION

The invention provides a foundation unit which is readily amenable to storage and shipment in a collapsed orientation, and which can be later reassembled with little effort and consequently low cost. In addition, since the foundation unit can be maintained in a collapsed state until its use is required, several foundation units can occupy the same space as one fully assembled unit, thereby substantially reducing storage and shipping costs.

The foundation unit is composed of a rigid bottom substructure, such as a wooden frame, and a flat top bearing structure. The top bearing structure and the bottom substructure have approximately the same rectangular dimensions, as is typical for foundation units.

Support means is provided intermediate the top bearing structure and the bottom substructure for maintaining a determined depth of the foundation unit when it is assembled. The support means comprises a plurality of spaced, parallel rows of support members extending substantially between the opposite lateral side edges of the top bearing structure, with a plurality of the rows of support members being located intermediate the end edges of the foundation unit. At least a portion of the rows of the support members is composed at least in part of a plurality of spring wire segments, each of the spring wire segments comprising a pair of generally flat support elements each lying in a plane. Each support element has a top and bottom attachment leg, the bottom attachment legs of each spring wire segment being located substantially adjacent one another and the top attachment legs of each spring wire segment being spaced from one another such that the planes of the support elements of each segment form a generally V-shaped configuration. The spring wire segments are hingedly secured to the top bearing structure and the bottom substructure such that the V-shaped configuration can be eliminated to permit collapse of the foundation unit about one of the support elements of each of the spring wire segments.

In accordance with the preferred form of the invention, each of the two support elements of each spring wire segment comprises a sinuous wire. The support elements of each spring wire segment are oriented opposite one another such that each segment is balanced. In that orientation, the top attachment legs and bottom attachment legs of each spring wire segment are oriented in directions opposite to one another.

In the preferred form of the invention, the planes of the support elements are parallel to the side edges of the foundation unit. For further stabilization, a row of spring wire segments is provided at each end edge of the foundation unit, the planes of the support elements of the spring wire segments of each of the end edge rows being parallel to the end edges, rather than parallel to the side edges. In other words, the spring wire elements of the end edge rows are turned 90° with respect to the spring wire segments of the remainder of the foundation unit.

A clip secures the top attachment leg of one of the support elements of each spring wire segment to one of the grid wires of the top bearing structure. A second clip secures the top attachment leg of the other of the support elements of each spring wire segment to a second grid wire spaced from the first. A staple secures only one of the bottom attachment legs of the two support elements of each spring wire segment to the bottom substructure, so that the foundation unit can be collapsed. When the foundation unit is to be raised, the support element of each spring wire segment which has the unsecured bottom attachment leg is rotated until the bottom attachment leg of each spring wire segment are substantially adjacent to one another, and the planes of the elements form a generally V-shaped configuration. Each of the unsecured bottom attachment legs is then stapled to the bottom substructure.

BRIEF DESCRIPTION OF THE DRAWINGS

The invention is described in greater detail in the following description of examples embodying the best mode of the invention, taken in conjunction with the drawings, in which.

DESCRIPTION OF EXAMPLES EMBODYING THE BEST MODE OF THE INVENTION

Figure 1:
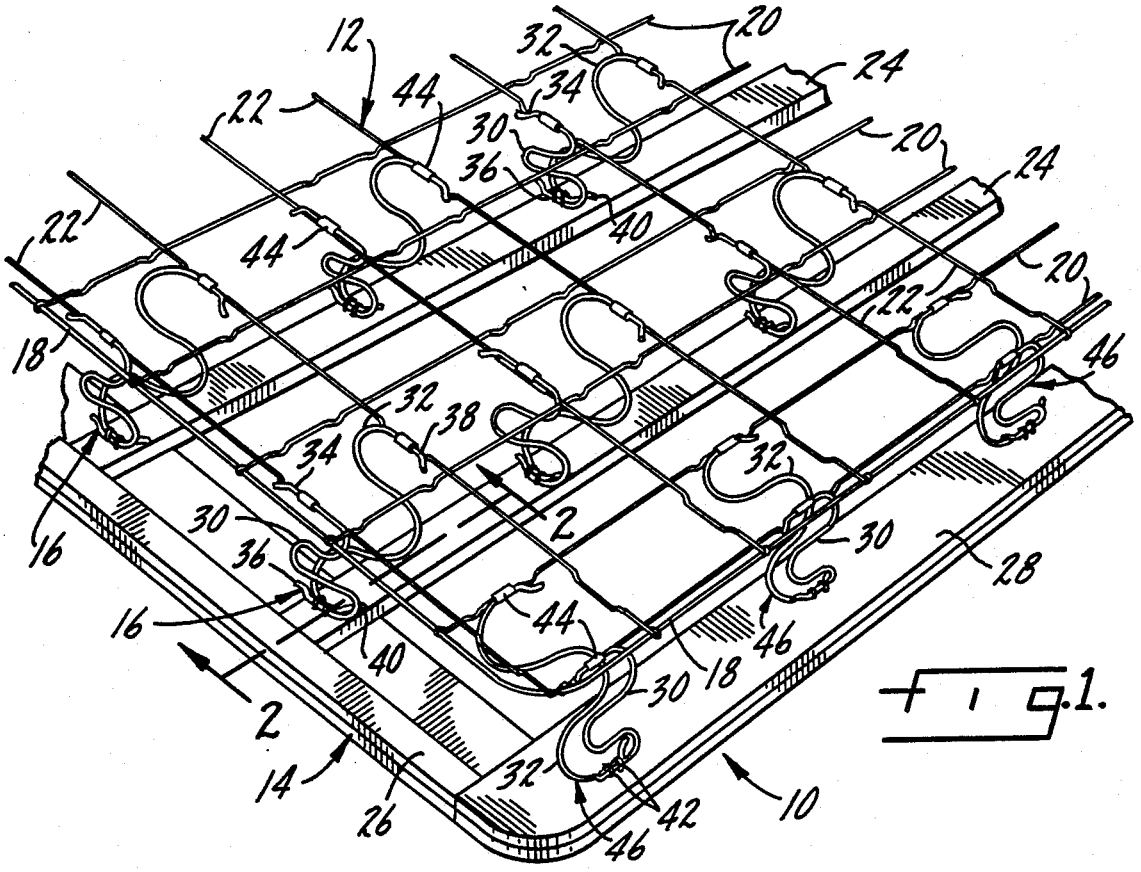
FIG. 1 is a partial perspective view of a foundation unit according to the invention.
Figure 6:
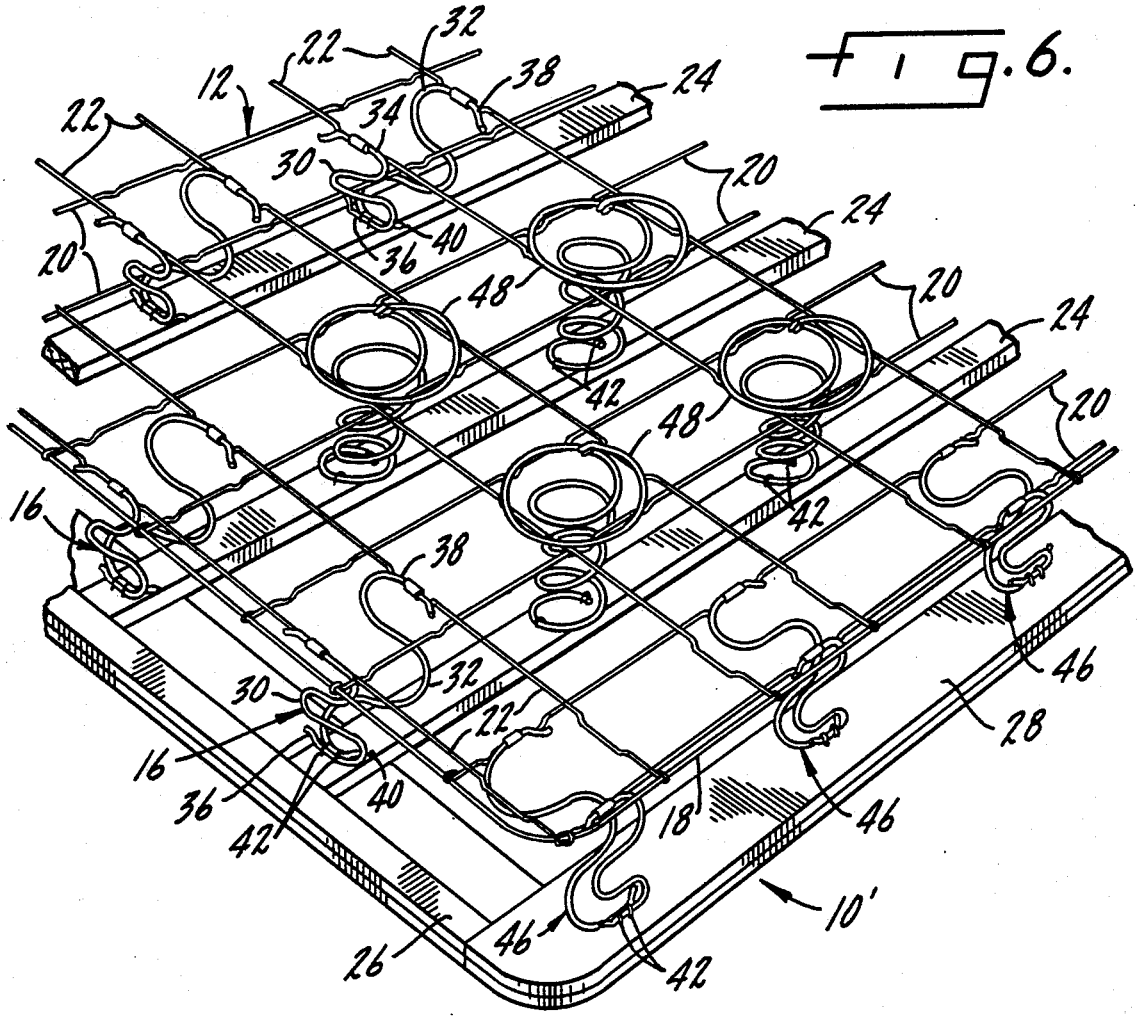
FIG. 6 is a partial perspective view of a second form of foundation unit according to the invention.

The invention is of the character illustrated in referenced U.S. Pat. No. 4,377,279. A steel wire foundation according to the invention is shown generally at 10, and is composed of a rectangular, grid wire top bearing structure 12, a rigid bottom substructure 14, such as a wooden frame, and a series of spaced, parallel rows of support members 16 extending substantially between opposite lateral side edge of the bearing structure 12. Although only a portion of a foundation unit 10 according to the invention is illustrated in FIGS. 1 and 6, it will be understood that the various components described are repeated in a regular fashion throughout the extent of the foundation 10, in a conventional fashion as illustrated in referenced U.S. Pat. No. 4,377,279.

The top bearing structure 12 may be of any conventional design, or as illustrated may be of the character described in U.S. Pat. No. 3,953,903. The top bearing structure 12 is composed of a perimeter border member 18 and a series of parallel transverse rows 20 and longitudinal columns 22 of grid wires extending between opposed edges of the perimeter border member 18. As is conventional, it is preferred that the rows 20 and columns 22 of grid wires be welded to one another at all cross locations and also be welded to the perimeter border member 18, or otherwise affixed thereto as appropriate. It should be evident that other suitable means of affixing the wires to one another can be used, and forms no part of the invention.

The bottom substructure 14 may also be of a conventional construction. The bottom substructure 14 illustrated in the drawing figures comprises a wooden frame having a series of cross slats 24 extending between longitudinal side slats 26. Opposite ends of the longitudinal side slats 26 are capped by end slats 28. The slats are glued, stapled, nailed or otherwise affixed to one another as necessary, again forming no part of the invention.

Figure 2:
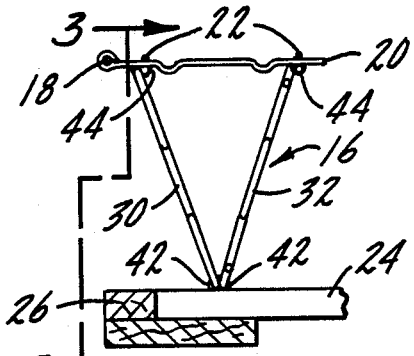
FIG. 2 is an enlarged cross-sectional view taken along lines 2—2 of FIG. 1 and illustrating one of the wire support members.

The support members 16 are attached to the foundation unit between the top bearing structure 12 and the bottom substructure 14. Each of the support members 16 is composed of a pair of spring wire segments formed in a generally V-shaped configuration, as best shown in FIG. 2. Each spring wire segment is composed of a pair of generally flat support elements 30 and 32, each lying substantially in a single plane. The support elements 30 and 32 are formed of sinuous wires, three curves being preferred, as in referenced U.S. Pat. No. 4,770,397. The support element 30 terminates in a top attachment leg 34 at the top thereof and a bottom attachment leg 36 at the bottom thereof. Similarly, the support element 32 includes a top attachment leg 38 and a bottom attachment leg 40. Staples 42 are used to attach the bottom attachment legs 36 and 40 to a cross slat 24, while conventional clips 44 are used to secure the top attachment legs 34 and 38 to appropriate grid wires 22.

The grid wires 22 are spaced sufficiently so that the support elements 30 and 32 are secured to adjacent grid wires 22. It should be evident that if the grid wires 22 are spaced closer to one another, the support elements 30 and 32 may be attached to every other grid wire 22 or otherwise, as appropriate. Furthermore, the extent of the V-shaped configuration shown in FIG. 2 is that preferred, although a wider or narrower V can be employed, again dependent upon the spacing of the grid wires 22.

The rows of support members 16 are quite sufficient to maintain the foundation 10 in the upright orientation illustrated in FIG. 1. The planes of the support elements 30 and 32 are parallel to the portions of the perimeter border member 18 at the sides of the foundation 10. For additional stability, a row of support members 46 may be employed at each end of the foundation 10. The support members 46 are identical to the support members 16 (and thus otherwise bear identical reference numerals), the only difference being that the support members 46 are oriented 90° with respect to the support members 16, the support members 46 having the planes of their support elements 30 and 32 parallel to the perimeter border member 18 at the ends of the foundation 10. The support members 46 are secured by clips 44 to the transverse grid wires 20 at each end of the foundation 10, and are secured by appropriate staples 42 to the end slats 28, in a fashion identical to the support members 16.

Figure 3:
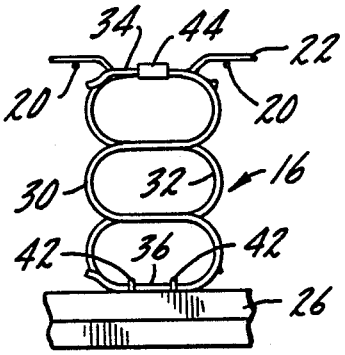
FIG. 3 is a cross-sectional view taken along lines 3—3 of FIG. 2.

As best shown in FIG. 3, although the support elements 30 and 32 of each of the support members 16 (and support members 46) are identical to one another, they are oriented in opposite directions when installed in the foundation 10. That is, the support element 30 has its central bend oriented to the left in FIG. 3, while the support element 32 has its central bend oriented to the right. Such orientation balances the foundation 10, evenly distributing applied forces and bending forces when the foundation 10 is in use. Consequently, there is no racking, twisting, or inappropriate deformation of the foundation 10.

Figure 4:
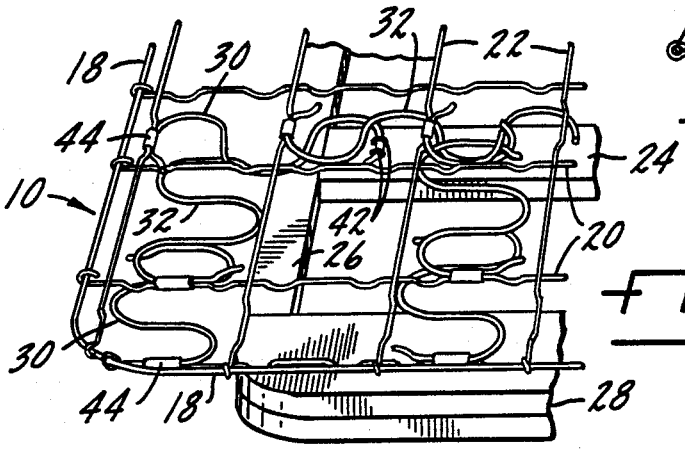
FIG. 4 is a perspective view of one corner of foundation unit of FIG. 1 when in the collapsed orientation.
Figure 5:
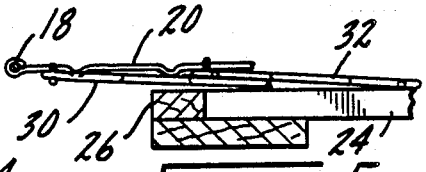
FIG. 5 is a cross-sectional, elevational view of one end of the foundation unit of FIG. 1 when collapsed.

Similar to the foundation of U.S. Pat. No. 4,377,279, the foundation 10 can be shipped in a knocked down fashion, illustrated schematically in FIGS. 4 and 5. The clips 44 and staples 42 naturally provide a hinging connection of the support elements 30 and 32. However, since the support elements 30 and 32 of each of the support members 16 are oppositely directed, the erected foundation 10 shown in FIG. 1 is held rigidly in place. For the foundation 10 to be collapsed, both of the bottom attachment legs of the support members 46 must be unattached to the end slats 28, and one of the bottom attachment legs 36 or 40 of a respective support element 30 or 32 of each of the support members 16 must not be attached to its respective cross slat, as well. As shown in FIGS. 4 and 5, each of the support elements 30 and 32 is secured by a clip 44 to a grid wire 22. However, only the support element 30 of each support member 16 is secured by staples 42 to the appropriate cross slat 24. With the bottom legs of each of the support elements of the support members 46 being unattached, the foundation 10 is easily collapsed to the orientation shown in FIGS. 4 and 5, the clips 44 and staples 42 forming hinged connections between the top bearing structure 12 and bottom substructure 14.

To erect the foundation 10, the top bearing structure 12 is raised to the upright orientation shown in FIG. 1. Each of the unattached support elements 32 is then rotated downwardly until the bottom attachment leg 40 of each of the support elements 32 is adjacent to the bottom attachment leg 36 of the associated support element 30. The bottom attachment legs 40 are then stapled in place. At the same time, the support elements 30 and 32 for each of the support members 46 are rotated downwardly and stapled in place in the orientation shown in FIG. 1. The foundation 10 is then ready for application of appropriate padding and a cover.

Due to the orientation of the support members 16, which form the vast majority of the support members for the foundation 10 (the support members 46 being only at opposite ends of the foundation), collapsing of the foundation 10 is toward one of the sides of the foundation rather than from end-to-end, as depicted in U.S. Pat. No. 4,377,279. While the orientation of the support members 16 shown in FIG. 1 is that preferred, obviously if the members 16 were turned 90°, collapsing of the foundation 10 would be possible in the end-to-end direction rather than side-to-side.

FIG. 6 illustrates a second form of the invention in which a foundation 10' has certain of the support members 16 replaced by coil springs 48. Otherwise, the foundation 10' is identical to the foundation 10 of FIGS. 1–5, and like elements bear identical reference numerals and will not be discussed further.

Inclusion of the coils springs 48, which are installed in accordance with conventional means or that described in greater detail in U.S. Pat. No. 3,953,903, provides greater versatility for the foundation 10'. The coil springs 48 may be made to have differing compressibility as opposed to the support members 16, and as a result differing support characteristics can be introduced in desired areas in the foundation 10'. For example, areas of the foundation 10' requiring stiffer support can be made including the support members 16, while those areas requiring greater compressibility can be made employing the coil springs 48. It will be evident to one skilled in the art that the coil springs 48 can (or cannot) be used as desired to affect the load bearing characteristics of the foundation 10'.

The foundation 10' is constructed in essentially the same manner as the foundation 10. The only difference is that introduction of the coil springs 48 is delayed until the foundation has been raised to the upright orientation and the support members fully formed by stapling the appropriate bottom attachment legs adjacent one another. Thereafter, the coil springs 48 are installed, being snapped into the top bearing structure 12 and stapled with staples 42 to the cross slats 24.

Figure 7:
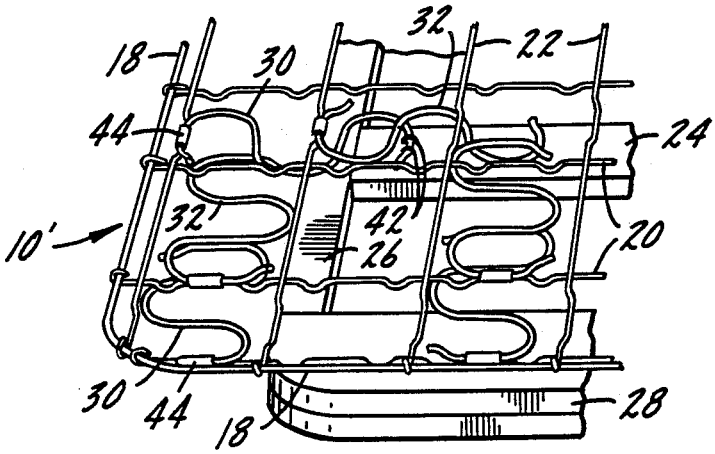
FIG. 7 is a perspective view of one corner of foundation unit of FIG. 6 when in the collapsed orientation.

It is intended that the foundation 10' be shipped and stored in the collapsed orientation, as shown schematically in FIG. 7. The only difference between the collapsed orientation in FIG. 7 as opposed to that of FIG. 4 is the fact that the coil springs 48 cannot be folded or otherwise incorporated into the collapsed form of the foundation 10'. As a result, the coil springs 48 are not packaged with the foundation 10' in the collapsed orientation but rather are either shipped separately with a series of collapsed foundations 10', or are provided separately by the purchaser of the collapsed foundations 10' from stock on hand.

It will be evident that various changes can be made to the invention without departing from the spirit thereof or scope of the following claims.

What is claimed is:

1. In a foundation unit having a flat top bearing structure composed of spaced grid wires, the foundation unit being of determined depth and generally rectangular in shape and having opposite longitudinal end edges and opposite lateral side edges, said foundation unit further having a bottom substructure and support means intermediate the top bearing structure and the bottom substructure for maintaining the determined depth, the improvement comprising a. said support means comprises a plurality of spaced, parallel rows of support members extending substantially between the opposite lateral side edges of the top bearing structure, with a plurality of said rows of support members being located intermediate said end edges, b. at least a portion of said rows of support members being composed at least in part of a plurality spring wire segments, each of said spring wire segments comprising a pair of generally flat support elements each lying in a plane, each support element having top and bottom attachment legs, the bottom attachment legs of each segment being located substantially adjacent one another and the top attachment legs of each segment being spaced from one another such that the planes of said elements form a generally V-shaped configuration, and c. means hingedly securing said spring wire segments to said top bearing structure and said bottom substructure such that said V-shaped configuration is eliminated to permit collapse of the foundation unit about one of the support elements of each of said spring wire segments.

2. A foundation unit according to claim 1 in which each of said support elements comprises a sinuous wire.

3. A foundation unit according to claim 2 in which the support elements of each spring wire segment are oriented opposite one another such that each segment is balanced.

4. A foundation unit according to claim 3 in which the top attachment legs and bottom attachment legs of each spring wire segment are oriented opposite one another.

5. A foundation unit according to claim 1 in which the planes of said support elements are parallel to said side edges.

6. A foundation unit according to claim 5 including a row of said spring wire segments at each end edge, the planes of the support elements of the spring wire segments of said end edge rows being parallel to said end edges.

7. A foundation unit according to claim 1 in which said means hingedly securing comprises a clip securing the top attachment leg of one of the support elements of each spring wire segment to a first grid wire and a clip securing the top attachment leg of the other of the support elements of each spring wire segment to a second grid wire spaced from the first grid wire, and a staple securing only one of the bottom attachment legs of the two support elements of each spring wire segment to said bottom substructure.

8. A foundation according to claim 1 in which the support members in some of said rows of support members are composed in part of a plurality of spaced coil spring elements.

9. A method of assemblying a foundation unit, the foundation unit having a flat top bearing structure composed of spaced rigid grid wires, the foundation unit having a determined depth when assembled and being generally rectangular in shape, said foundation unit further having a bottom substructure and support means intermediate the top bearing structure and the bottom substructure for maintaining the determined depth when assembled, the method comprising the steps of a. forming said support means as a plurality of spaced, parallel rows of support members, the support members being composed at least in part of a plurality of spring wire segments, each of said spring wire segments comprising a pair of generally planar support elements, each having top and bottom attachment legs, b. hingedly securing the top attachment leg of one of the support elements of each spring wire segment to a first grid wire and hingedly securing the top attachment leg of the other of the support elements of each spring wire segment to a second grid wire spaced from the first grid wire, c. hingedly securing only one of the bottom attachment legs of the two support elements of each spring wire segment to said bottom substructure, d. raising said top bearing structure to said determined depth, e. rotating the support element of each spring wire segment which has the unsecured bottom attachment leg until the bottom attachment legs of each spring wire segment are substantially adjacent one another and planes of said elements form a generally V-shaped configuration, and f. securing each unsecured bottom attachment leg to said bottom substructure.

10. A method according to claim 9 in which a portion of said support members is composed of a plurality of coil spring elements, and including the final step of securing said coil spring elements to said top bearing structure and said bottom substructure.

* * * * *